US005762128A

United States Patent [19]

Counterman et al.

[11] Patent Number: 5,762,128

[45] Date of Patent: Jun. 9, 1998

[54] ON-LINE REGENERATIVE AIR PREHEATER FOULING SENSING SYSTEM

[75] Inventors: Wayne S. Counterman; James D. Seebald, both of Wellsville, N.Y.

[73] Assignee: ABB Air Preheater, Inc., Wellsville, N.Y.

[21] Appl. No.: 746,775

[22] Filed: Nov. 15, 1996

[51] Int. Cl.[6] ..... F23L 15/02

[52] U.S. Cl. ..... 165/8; 165/6; 165/5; 165/11.2; 165/11.1

[58] Field of Search ..... 165/11.2, 11.1, 165/6, 8, 5, 200

[56] References Cited

U.S. PATENT DOCUMENTS

| | | | |
|---|---|---|---|
| 3,412,786 | 11/1968 | Taylor | 165/5 |
| 3,730,259 | 5/1973 | Wixson et al. | 165/5 |
| 3,861,458 | 1/1975 | Ostrander et al. | 165/5 |
| 4,019,567 | 4/1977 | Wixson et al. | 165/5 |
| 4,022,270 | 5/1977 | Stockman | 165/5 |
| 4,040,473 | 8/1977 | Wheeler | 165/5 |
| 4,192,372 | 3/1980 | Bellows | 165/5 |

FOREIGN PATENT DOCUMENTS

| | | | |
|---|---|---|---|
| 0279095 | 11/1988 | Japan | 165/5 |
| 0143093 | 6/1990 | Japan | 165/5 |
| 3241288 | 10/1991 | Japan | 165/5 |

*Primary Examiner*—Denise L. Ferensic
*Assistant Examiner*—Christopher Atkinson
*Attorney, Agent, or Firm*—Alix, Yale & Ristas, LLP

[57] ABSTRACT

A fouling sensing system monitors fouling of a rotary regenerative preheater having a housing and a rotor rotatably mounted therein. An emitter for emitting energy is positioned at one of the faces of the rotor and emits energy through the rotor. A sensor is positioned at the other face of the rotor for receiving the energy and generating an output signal indicative of the intensity of the energy.

12 Claims, 3 Drawing Sheets

ON-LINE REGENERATIVE AIR PREHEATER FOULING SENSING SYSTEM

BACKGROUND OF THE INVENTION

This invention relates to the field of rotary regenerative air preheaters for use in combustion power generation systems. More specifically, this invention relates generally to a sensing system for a rotary regenerative preheater.

Rotary regenerative preheaters are well known for the transfer of heat from a post-combustion flue gas stream to a pre-combustion air stream. Conventional rotary regenerative preheaters have a circular housing and a rotor rotatably mounted therein. The rotor contains heat transfer elements for the transfer of heat from the flue gas stream to the air stream. The housing defines a flue gas inlet duct, a flue gas outlet duct, an air inlet duct and an air outlet duct. Sector plates divide the preheater into an air side and a flue gas side wherein hot flue gas enters the flue gas inlet and passes through the rotor. The hot flue gas transfers heat to the heat transfer elements in the rotor. The cold flue gas exits the preheater through the flue gas outlet. An air stream enters the heater through an air inlet and passes through the heated rotor. The heat transfer elements of the rotor transfer heat to the air stream and the heated air exits the preheater through the air outlet duct.

Soot and other particulates in the flue gas stream can be deposited on the heat transfer elements of the rotor. These deposits typically collect on the hot end of the heat transfer surface of the rotor. Furthermore, fly ash in the flue gas can combine with moisture and sulfur derivatives to form a fine grain deposit or scale, particularly on the cold end of the heat transfer surface of the rotor. The collection of deposits in the hot and cold ends of the rotor affect flue gas and air flow and degrade heat transfer performance.

Conventionally, the heat transfer elements of the rotor have been cleaned by use of sootblowing and washing equipment. Sootblowing equipment employs superheated steam or dry compressed air to remove soot and other particulates from the heat transfer elements. When sootblowing is inadequate to remove deposits, washing of the rotor is initiated. Washing equipment requires the rotary regenerative preheater to be taken off line in order to perform the cleaning procedures. Conventional washing equipment employs water to dissolve the soot and other particulates from the heat transfer elements.

The required frequency of sootblowing the rotor is typically determined by monitoring the pressure drop across the rotor. However, pressure drop monitoring has proven to be an unreliable indicator of soot accumulation. Typically, a pressure drop sufficiently large to alert the operator indicates the fouling deposits have already built up to a point where they are difficult to remove. Therefore the sootblowing should have been initiated at an earlier time. This is particularly true of temperature driven fouling such as ammonium bisulfate formation that typically occurs in a 12–24 inch band within the total element depth which typically varies from 74 to 120 inches.

Such a narrow band of fouling deposits will not increase the pressure drop across the total element depth to a detectable degree until it has drastically reduced the open flow area in the fouled band. At that point, the sootblowing penetration is greatly reduced by the restriction of that band and therefore the deposit can not be easily removed.

As a result of the deficiencies of pressure drop monitoring, sootblowing is typically initiated at a timed frequency. Timed frequency sootblowing typically shortens element life since a very conservative, high frequency sootblowing schedule is often utilized. Timed frequency sootblowing can further prove inadequate when an upset occurs in the boiler operation, fouling the rotor of the preheater between scheduled sootblowing cycles.

SUMMARY OF THE INVENTION

Briefly stated, the invention in the preferred form is an on-line regenerative air preheater fouling sensing system for measuring fouling accumulation on the rotor of a rotary regenerative preheater.

The preferred fouling sensing system of the invention has an emitter assembly and a sensor assembly. The emitter assembly for emitting energy is positioned in one of the ducts on either the air side or flue gas side of the rotary regenerative heater. Positioned in the opposite duct of the stream in which the emitter is located, is the sensor assembly for sensing the energy of the emitter. The emitter assembly can emit an electromagnetic wave, sound or nuclear particle radiation. The emitted energy passes through the rotor and is received by the sensor assembly. For a constant level of transmitted energy, the open passages through the heat transfer element will allow some percentage of the transmitted energy to pass through. Monitoring of the change or reduction in the energy received by the sensor assembly indicates the level of fouling experienced by the heat transfer elements. Therefore sootblowing can be initiated only when required. Employment of the fouling sensing system of the invention avoids unnecessary sootblowing and increases heat transfer element life by initiating sootblowing before deposits are difficult to remove.

An object of the invention is to provide a on-line regenerative air preheater fouling sensing system for sensing the amount fouling of heat transfer elements in the rotor of the preheater.

Another object of the invention is to provide a fouling sensing system to allow more efficient timing of sootblowing operations.

A further object of the invention is to provide a fouling sensing system for measuring the relative fouling of heat transfer elements.

These and other objects of the invention will be apparent from review of the specification and drawings.

DESCRIPTION OF THE PREFERRED EMBODIMENT

Figure 1:
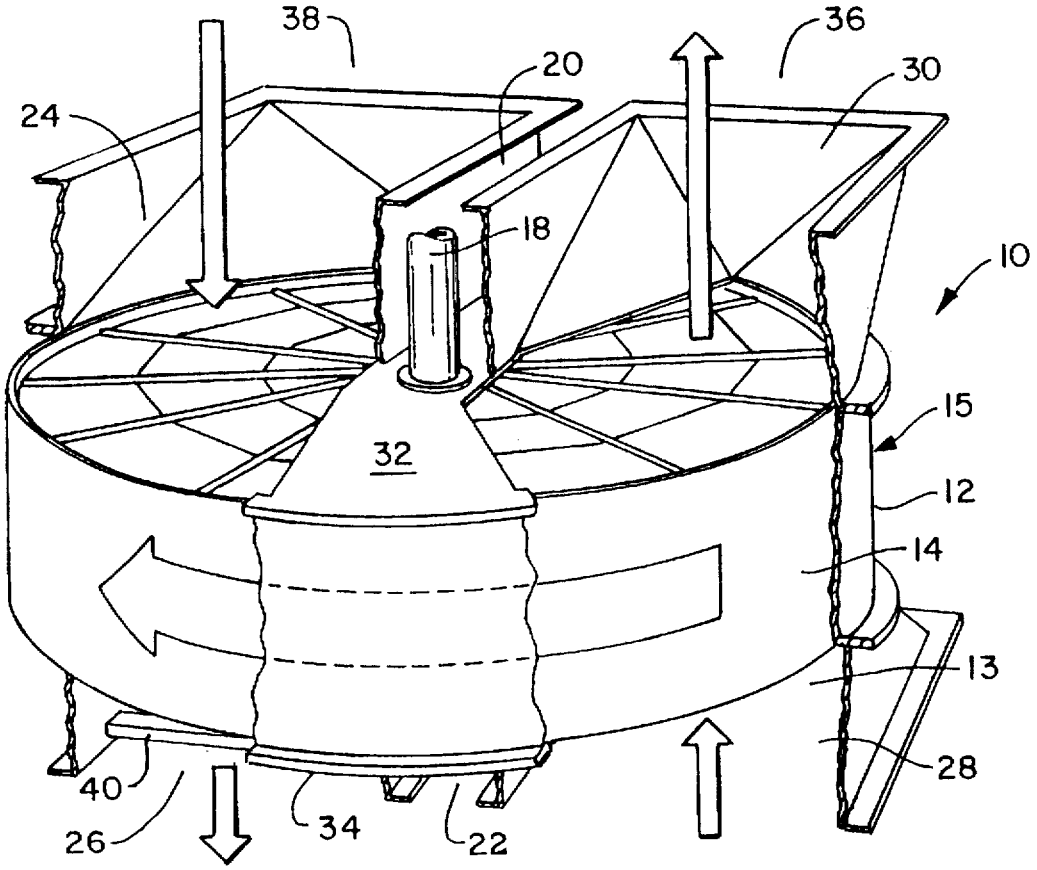
FIG. 1 is a partially broken away view of a rotary regenerative preheater.

A rotary regenerative preheater is generally designated by the numeral 10. The preheater 10 has a casing 12 defining an internal casing volume 13. Rotatably mounted within the casing 12 is a rotor 14 having conventional heat exchange elements for the transfer of heat. (See FIG. 1)

The rotor 14 has a shaft or rotor post 18 to support the rotor 14 for rotation within the casing 12. The rotor post 18 extends through a hot end center section 20 and a cold end center section 22. Attached to the casing 12 are a flue gas inlet duct 24 and a flue gas outlet duct 26 for the flow of heated flue gases through the preheater 10. Also attached to the casing 12 are an air inlet duct 28 and an air outlet duct 30 for the flow of pre-combustion air through the preheater 10. The casing 12, flue gas ducts 24, 26 and air ducts 28, 30 form a preheater housing 15. Extending across the housing 15, adjacent the upper and lower faces of the rotor 14, are sector plates 32, 34 which divide the preheater 10 into an air side 36 and a flue gas side 38. The arrows of FIG. 1 indicate the direction of air and flue gas flow through the preheater 10.

Hot flue gas entering through the flue gas inlet duct 24 transfers heat to the heat transfer elements in the continuously rotating rotor 14. The heated heat transfer elements are then rotated into the air side 36 of the rotary regenerative preheater 10. The stored heat of the heat transfer elements is then transferred to the combustion air stream entering through the air inlet duct 28. The cooled flue gas exits the preheater 10 through the flue gas outlet duct 26 and the heated pre-combustion air exits the preheater 10 through the air outlet duct 30.

Soot, particulates, and chemical compounds in the flue gas stream collect and condense on the heat transfer elements of the rotor 14 to form deposits and scale that restrict air and flue gas flow through the preheater 10. A sootblowing apparatus 40 is typically positioned in one of the ducts 24, 26, 28, 30 to remove these soot deposits and scale from the heat transfer elements of the rotor 14. The sootblowing apparatus 40 is preferably positioned in the flue gas outlet 26 to prevent fly ash from being blown into the wind boxes located downstream from the air side 36 of the preheater 10. The sootblowing apparatus 40 blows superheated steam or dry compressed air onto the heat transfer elements of the rotor 14 to remove the scale and deposits.

Figure 2:
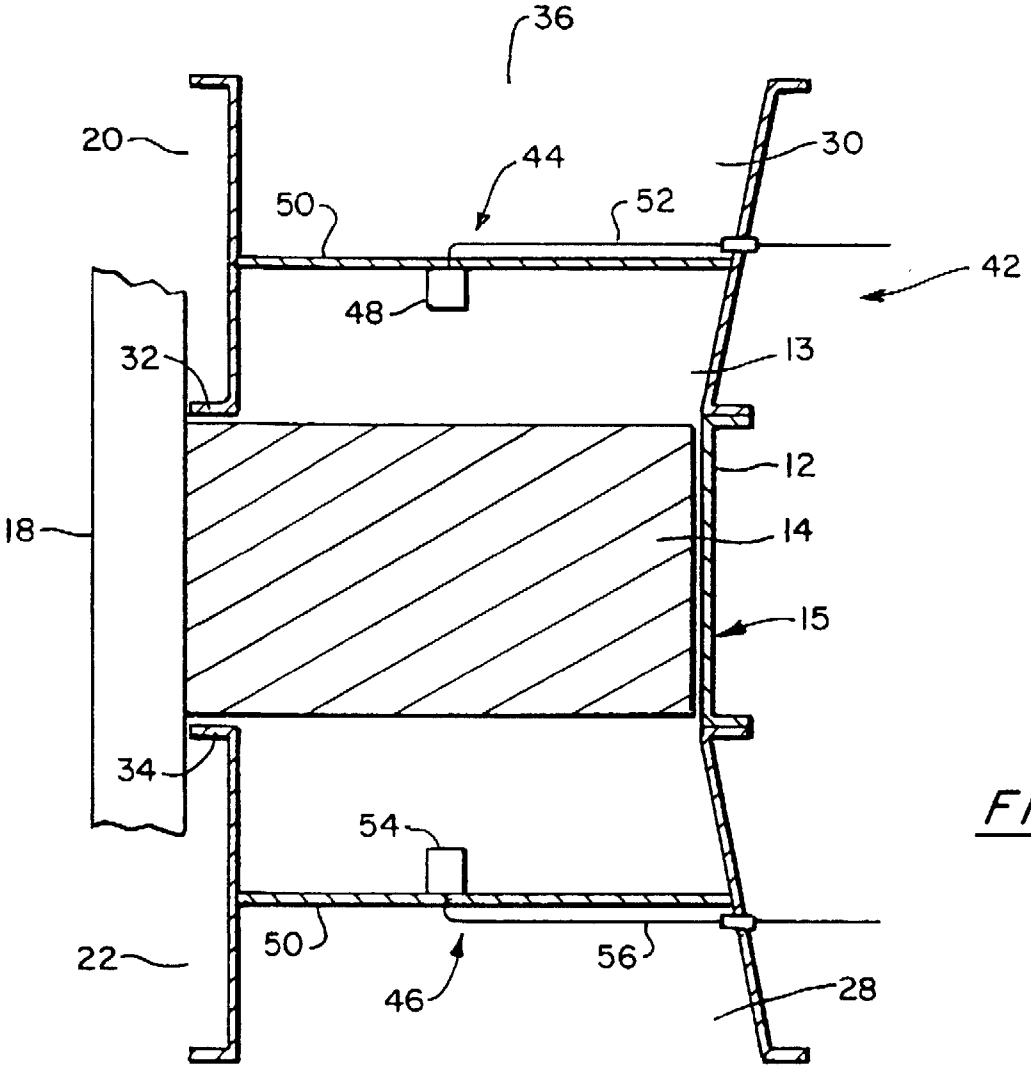
FIG. 2 is a cross-sectional view of a portion of a rotary regenerative preheater shown in combination with a fouling sensing system of the invention.

An on-line regenerative air preheater fouling sensing system 42 in accordance with the invention is positioned to sense fouling of the heat transfer elements in the rotor 14. (See FIG. 2) Accurate timing of sootblowing for increased efficiency and rotor life can be accomplished by employment of the fouling sensing system 42. The fouling sensing system 42 has an emitter assembly 44 and a sensor assembly 46 along with appropriate instrumentation.

The fouling sensing system 42 is positioned on either the air side 36 or the flue gas side 38 of the air preheater 10. The emitter assembly 44 can be positioned in any of the four ducts, the flue gas inlet duct 24, the flue gas outlet duct 26, and air inlet duct 28 or the air outlet duct 30. The sensor assembly 46 is positioned on the other side of the heat transfer elements from the emitter assembly 44, on the same air side 36 or flue gas side 38 of the preheater 10. The fouling sensing system 42 is preferably located on the air side 36 of the preheater 10 in order to reduce the accumulation of soot, particulates and other contaminants on the fouling sensing system 42.

The emitter assembly 44 has an emitter source 48 supported in the air outlet duct by a support brace 50. The emitter source 48 emits energy for penetration through the heat transfer elements of the rotor 14. The energy emitted by the emitter source 48 can be electromagnetic waves either oriented, such as a laser, or a normal light having a more diffused pattern. The electromagnetic waves can cover the visible and non-visible frequencies. The emitter source 48 can also emit sound, including frequencies in the range of ultrasonic and infrasonic, or emit nuclear particle or nuclear electromagnetic radiation (X-rays). The emitter source can be supplied by an emitter cable 52 passing through the housing 15 to a remote location (not shown). Nuclear sources have the advantage of not requiring an outside power source in order to function. In addition, selection of a radio active source with an extended half-life allows for a steady output with reduced maintenance.

Although only one emitter source 48 has been illustrated, there may be a plurality of emitter sources mounted in multiple positions across the radius of the rotor to more effectively monitor the entire rotor. Alternately, a single emitter source can be mounted to move in and out across the radius.

The sensor assembly 46 has a sensor 54 mounted to a second support brace 50. The appropriate sensor 54 is correlated to the choice of the emitter source 48. The sensor 54 is connected by a sensor cable 56 passing through the housing 15 to a sensor instrumentation and control unit (not shown). The sensor 54 is preferably positioned generally opposite the emitter source 48. If the emitter source is mounted for movement, the sensor 54 would also be mounted for synchronous movement. The emitter source 48 preferably emits a constant level of transmitted energy. The open passages through the heat transfer elements will pass or allow some percentage of the transmitted energy therethrough. The sensor assembly 46 monitors the change or reduction in the received energy after the energy passes through the rotor 14. The amount of fouling can be correlated and the plant operator warned that a sootblowing cycle needs to be initiated by monitoring the reduction in energy over an operating period. Most forms of electromagnetic emitter sources 48 will require a line of sight view through the heat transfer elements of the rotor 14. Sound based or high energy nuclear base emitter sources 48 would not require a direct line of sight view through the heat transfer elements of the rotor 14.

Figure 3:
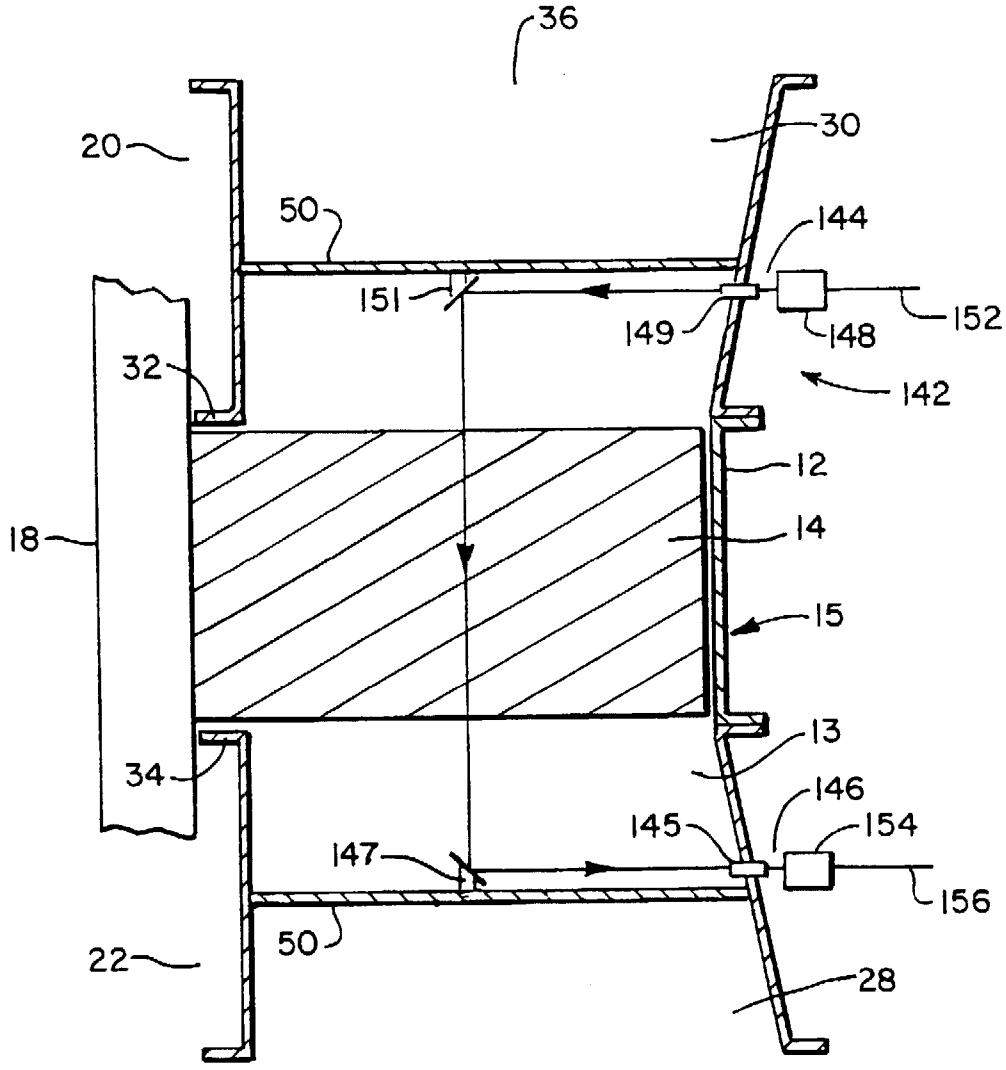
FIG. 3 is a cross-sectional view of a portion of a rotary regenerative preheater shown in combination with a further embodiment of the fouling sensing system of the invention.

In an alternate embodiment of the invention, a fouling sensing system 142 has an emitter assembly 144 and a sensor assembly 146. (See FIG. 3) The sensor assembly 146 can also be positioned in either the flue gas side 38 or the air side 36 of the preheater 10. The emitter assembly 144 has an emitter source 148 located outside the housing 15. The emitter source 148 is preferably a light source. The light of the emitter source 148 is directed through a port 149 in the housing 15 and is reflected from a reflector or mirror 151 preferably located in the air outlet duct 28. The mirror 151 is supported in the air outlet duct 28 by a support brace 50. The mirror 151 reflects the light from the emitter source 48 through the heat transfer elements of the rotor 14.

The sensor assembly 146 has a reflector or mirror 147 for reflecting the light from the emitter source 148 through a port 145 in the housing 15. The sensor assembly 146 further has a sensor 154 for receiving the light from the emitter source 148 and generating an output signal indicative of the intensity of the light received. The output signal from the sensor 154 is transferred to a central control system (not shown) over a sensor cable 156. Alternately, the emitter source 148 and sensor 154 can be located on the housing 15 within the ducts 24, 26, 28, 30.

In a further embodiment of the sensor assembly 146, the reflectors or mirrors 147, 151 can be fiber optic cables. The light of the emitter source 148 can be caught on or focused on the fiber optic cable and transmitted to the sensor 154 located at an accessible position outside the housing 15. Similarly, the light output of the emitter source 148 can be directed by a fiber optic cable through the housing 15 and directed through the heat transfer elements on the rotor 14 for detection by the sensor assembly 146.

While preferred embodiments of the present invention have been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. A fouling sensing system for monitoring fouling of a rotary regenerative preheater, said sensing system comprising:

a preheater housing;

a rotor rotatably mounted in said housing, said rotor defining oppositely positioned rotor faces;

emitter means comprising an electromagnetic source for emitting energy through said rotor, sensor means for sensing said energy of said emitter means emitted through said rotor.

2. The fouling sensing system of claim 1 wherein said preheater housing defines an air side and a flue gas side and said emitter means and said sensor means are located in said air side of said preheater housing.

3. The fouling sensing system of claim 1 wherein said emitter means is positioned at one of said rotor faces and said sensor means is positioned at the other of said rotor faces.

4. A fouling sensing system for sensing fouling in a rotary regenerative preheater, said fouling sensing system comprising:

a casing defining a flue gas side and an air side, said air side comprising an air inlet duct and an opposite air outlet duct;

a rotor rotatably mounted in said casing for rotation between said air inlet duct and said air outlet duct;

emitter means comprising an electromagnetic source positioned in one of said air inlet duct and said air outlet duct for emitting energy through said rotor;

sensor means comprising an electromagnetic sensor positioned in the other of said inlet duct and said outlet duct for sensing emitted energy of said emitter means.

5. A fouling sensing system for sensing fouling in a rotary regenerative preheater, said fouling sensing system comprising:

a casing defining a flue gas side and an air side, said air side comprising an air inlet duct and an opposite air outlet duct:

a rotor rotatably mounted in said casing for rotation between said air inlet duct and said air outlet duct;

emitter means comprising an acoustic source positioned in one of said air inlet duct and said air outlet duct for emitting energy through said rotor; and sensor means comprising a sound sensor positioned in the other of said inlet duct and said outlet duct for sensing emitted energy of said emitter means.

6. A fouling sensing system for sensing fouling in a rotary regenerative preheater, said fouling sensing system comprising:

a casing defining a flue gas side and an air side, said air side comprising an air inlet duct and an opposite air outlet duct;

a rotor rotatably mounted in said casing for rotation between said air inlet duct and said air outlet duct;

emitter means comprising a nuclear radiation source positioned in one of said air inlet duct and said air outlet duct for emitting energy through said rotor; and sensor means comprising a nuclear radiation sensor positioned in the other of said inlet duct and said outlet duct for sensing emitted energy of said emitter means.

7. A fouling sensing system for monitoring fouling of a rotary regenerative preheater, said fouling sensing system comprising:

a preheater housing, said housing having a flue gas side and an air side, said air side comprising an air inlet duct and an oppositely positioned air outlet duct;

a rotor rotatably mounted in said housing for rotation between said air inlet duct and said air outlet duct;

emitter means for emitting electromagnetic energy into one of said air inlet duct and said air outlet duct;

reflector means in said one duct for reflecting said electromagnetic energy through said rotor; and sensor means for sensing said energy transmitted through said rotor.

8. The fouling sensing system of claim 7 wherein said reflector means comprises a fiber optic cable.

9. The fouling sensing system of claim 7 wherein said sensor means comprises a second reflector means in the other of said air inlet duct and said air outlet duct and a sensor outside of said housing, said second reflector means adapted to reflect said electromagnetic energy outside of said housing to said sensor.

10. The fouling sensing system of claim 9 wherein said second reflector means comprises a fiber optic cable.

11. The fouling sensing system of claim 9 wherein said second reflector means comprises a mirror.

12. The fouling sensing system of claim 7 wherein said reflector means comprises a mirror.

* * * * *